United States Patent [19]

Schantz

[11] 4,352,398

[45] Oct. 5, 1982

[54] CIRCUIT FOR PITCH AND TILT OF DOZER BLADE

[75] Inventor: Ronald K. Schantz, Libertyville, Ill.

[73] Assignee: International Harvester Co., Chicago, Ill.

[21] Appl. No.: 124,875

[22] Filed: Feb. 27, 1980

[51] Int. Cl.[3] ..... E02F 3/85; F15B 11/22

[52] U.S. Cl. ..... 172/812; 91/517; 91/518; 172/826

[58] Field of Search ..... 91/512, 514, 515, 517, 91/526, 531, 436, 171, 518; 172/812, 826

[56] References Cited

U.S. PATENT DOCUMENTS

| | | | |
|---|---|---|---|
| 2,460,774 | 2/1949 | Trautman | 91/515 |
| 3,033,219 | 5/1962 | Erle | 91/515 |
| 3,199,539 | 8/1965 | Leathem | 91/515 |
| 3,455,320 | 7/1969 | Garman | 91/515 |
| 3,850,081 | 11/1974 | Joelson | 91/515 |
| 3,850,323 | 11/1974 | Ekstrom | 91/518 |
| 3,961,670 | 6/1976 | Rivinius | 91/171 |
| 3,966,066 | 6/1976 | Schexnayder | 91/531 |
| 4,083,291 | 4/1978 | Larsson | 91/517 |
| 4,094,228 | 6/1978 | Schexnayder | 91/517 |
| 4,166,506 | 9/1979 | Tezuka | 91/512 |
| 4,194,436 | 3/1980 | Imada | 91/436 |
| 4,237,688 | 12/1980 | Demmers | 91/512 |

*Primary Examiner*—Abraham Hershkovitz
*Attorney, Agent, or Firm*—D. K. Sullivan; F. D. Au Buchon

[57] ABSTRACT

A circuit for controlling pitch and tilt of a dozer blade in which two cylinders are connected between the dozer blade and the dozer push arms. One cylinder only is extended and retracted to achieve tilt, and both cylinders are operated in unison to achieve pitch with divider valves assuring that equal volumes of hydraulic fluid reach each cylinder and are expelled from each cylinder. Extension and retraction is selectively determined by a directional control valve, while a selector valve determines whether both cylinders or only one cylinder is connected with the directional control valve.

4 Claims, 3 Drawing Figures

CIRCUIT FOR PITCH AND TILT OF DOZER BLADE

CROSS REFERENCE TO RELATED APPLICATIONS

This invention is related in subject matter to copending U.S. Application Ser. No. 125,398, filed by S. C. Kirkham, et al. and entitled Hydraulic Control for Pitch and Tilt of a Dozer Blade, and Ser. No. 125,397, filed by L. F. Kramer, et al. and entitled Hydraulic Control for a Dozer Blade. All these applications were filled of even date and have a common assignee.

BACKGROUND AND SUMMARY OF THE INVENTION

The desirability of providing pitch and tilt control for a dozer blade has long been recognized. Changes in pitch, i.e. fore and aft movement of the top of the blade by rotation of the blade about a transverse, essentially horizontal, axis near the bottom of the blade, have been effected by extension or retraction of a pair of hydraulic rams; one ram connected between the blade and each of the push arms. Changes in tilt, i.e. raising or lowering one edge or corner of the blade relative to the other corner, have been effected by extension or retraction of only one of these rams. While the mechanics of pitch and tilt have been known for some time, the hydraulic control thereof has been a problem. It is therefore, an object of this invention to provide a hydraulic control for a dozer blade which will permit both tilt and pitch functions with precision and accuracy.

It is also an object of this invention to provide such a hydraulic control which will permit changes in tilt without alteration of pitch and vice versa, within the mechanical limits of the dozer mechanism.

It is also an object of this invention to provide such a hydraulic control which minimizes cost while preserving accuracy and precise control.

These and other objects of the present invention, and many of the attendant advantages thereof, will become more readily apparent upon a perusal of the following description and the accompanying drawings, wherein.

DESCRIPTION OF A PREFERRED EMBODIMENT

Figure 1:
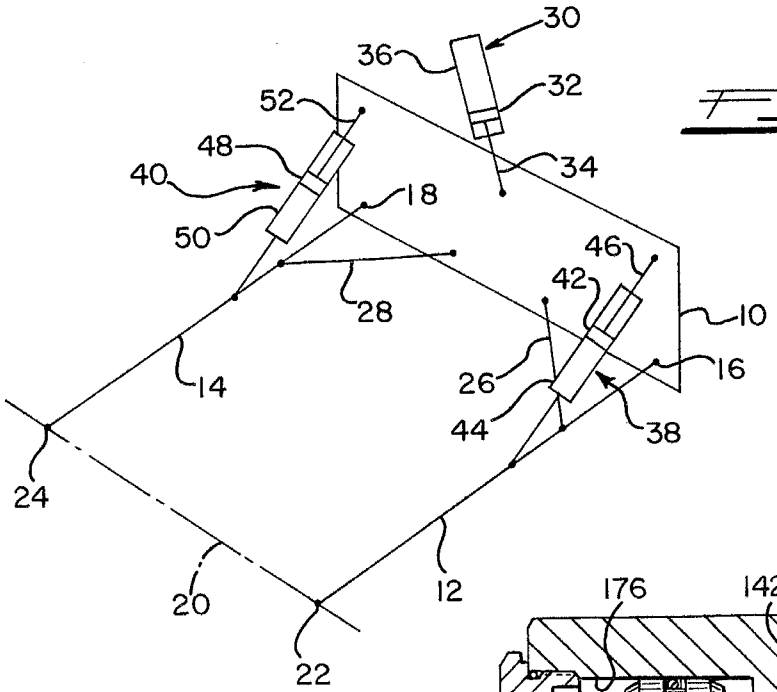
FIG. 1 is a schematic representation of a dozer blade arrangement for use with the present invention.

Referring first to the basic arrangement shown in FIG. 1, a dozer blade 10 is secured to a pair of push arms 12 and 14 by universal or ball connectors 16 and 18 respectively. The push arms 12 and 14 are connected to the vehicle at the points 22 and 24 to define a pivot axis 20. Diagonal braces 26 and 28 extend between the push arms 12 and 14 respectively and the blade 10 and provide lateral stability to the blade. A hydraulic ram 30, having a piston 32 with affixed rod 34 reciprocable within a cylinder 36, connects between the blade and the vehicle. Retraction of the ram 30 will raise the blade 10 as the push arms 12 and 14 are pivoted about the axis 20. Similarly, extension of the ram 30 will lower the blade 10. A pair of rams 38 and 40 are connected between the blade 10 and the push arms 12 and 14 respectively. The ram 38 has a piston 42 reciprocable within a cylinder 44 with a rod 46 affixed to piston 42 and protruding beyond the cylinder 44. The ram 40 has a piston 48 reciprocable within a cylinder 50 with a rod 52 affixed to piston 48 and protruding beyond the cylinder 50. Extension and retraction of both rams 38 and 40 in unison will pitch the blade forward and rearward. Extension and retraction of the ram 40, while holding the ram 38, causes the blade 10 to tilt to the right or left about a longitudinal axis essentially parallel to the push arms 12 and 14. The above structural arrangement and its operation are conventional and well known.

Figure 2:
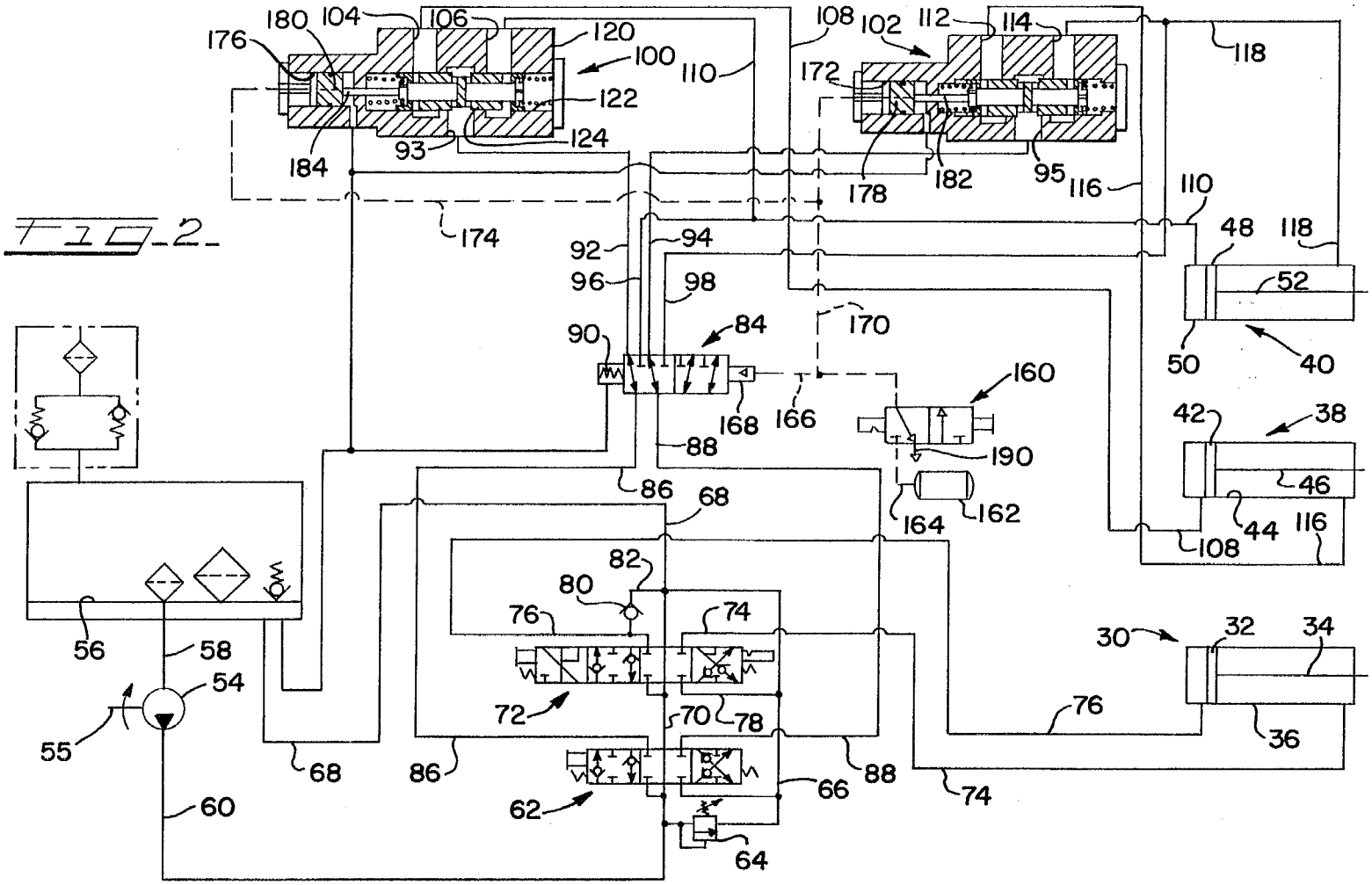
FIG. 2 is a hydraulic and pneumatic schematic drawing of a circuit employing the present invention.

The control for these three rams 30, 38 and 40 is the subject of this invention and is shown in FIG. 2, wherein a pump 54 driven by the prime mover or engine of the vehicle, as represented by the line 55, draws hydraulic fluid from a reservoir 56 through a conduit 58. Fluid under pressure is discharged by the pump 54 into supply conduit 60 and directed to an open center valve 62. A relief valve 64 is positioned in a conduit 66 which connects between the supply conduit 60 upstream of the valve 62 and the return conduit 68 which communicates with the reservoir 56. The valve 62 is used to control the pitch and tilt operations of the blade 10 in a manner to be explained hereinafter.

A conduit 70 connects the supply conduit 60 with a height or elevation valve 72 when the valve 62 is in its center neutral position, as shown in FIG. 2. A pair of conduits 74 and 76 connect the valve 72 with the rod end and head end respectively of the lift ram 30. Another conduit 78 connects the valve 72 with the conduit 66 and hence with the return conduit 68. In the center-neutral position shown, the conduits 74 and 76 are blocked, hydraulically locking the lift ram 30. When the valve 72 is moved to the left, as viewed in FIG. 2, conduit 74 receives fluid pressure from the pump 54 and conduit 76 is connected with the reservoir 68 through conduits 78, 66 and 68. Pressure in the rod end of the ram 30 causes it to contract and to thereby raise the blade 10. Similarly, when the valve 72 is moved to the right, as viewed in FIG. 2, the conduit 76 receives fluid pressure from the pump 54 through conduits 60 and 70 while conduit 74 is connected with the reservoir 56 through conduits 78, 66 and 68. In the event a downward force, such as gravity, acting on the blade 10 causes the piston 32 to move downward at a rate faster than the pump 54 can supply fluid to the head end side of the lift ram 30, cavitation would normally occur. Under those conditions the fluid being expelled from the rod end side of the ram 30 will cause the pressure in the conduit 78 and 66 to exceed the pressure in conduit 76. A check valve 80 is positioned in a conduit 82, which connects between the conduit 76 and the conduit 68 at its connection to the return conduit 66, and permits flow through conduit 82 only toward the conduit 76. Under conditions, as just described, where cavitation would normally occur, the pressure in conduit 76 would be lower than that in conduit 66 which permits the check valve 80 to open. The fluid exhausted from the rod end through conduits 74, 78 and 66 will then be directed into conduit 76 and will supplement the flow of hydraulic fluid from the pump 54 to the head end side of the ram 30. Movement of the spool of valve 72 even further to the right, as viewed in FIG. 2, will produce a "float" condition for the blade 10 in which it is free to move up or down as dictated by the sum of the external force acting on the blade. This float condition is achieved by interconnecting the two conduits 76 and 74 with each other and with the pressure conduit 70 and with the return conduits 68 and 78.

The directional control valve 62 is connected with a two position, selector valve 84 by means of a pair of conduits 86 and 88. The valve 84, which determines pitch or tilt operation, is biased by spring 90 to the right to its pitch position, as shown in FIG. 2, wherein the conduits 86 and 88 are in communication with conduits 92 and 94 respectively. Another pair of conduits 96 and 98 are blocked when the selector valve 84 is in the position shown. The conduits 92 and 94 connect the selector valve 84 respectively with ports 93 and 95 in diverter valves 100 and 102. The valve 100 has a pair of ports 104 and 106 to which conduits 108 and 110 are connected; the conduit 108 being in communication with the head end of ram 38 and conduit 110 being in communication with the head end of ram 40. The valve 102 also has a pair of ports 112 and 114 to which conduits 116 and 118 are connected; the conduit 116 being in communication with the rod end of ram 38 and conduit 118 communicating with the rod end of ram 40. The valves 100 and 102 are flow and pressure compensated to assure an equal split or 50-50 distribution of the hydraulic fluid, i.e. hydraulic fluid flowing through conduit 92 toward valve 100 will be equally split between the ports 104 and 106 in valve 100 and similarly, any flow in conduit 94 toward the valve 102 will be equally split between the ports 112 and 114. Conduit 92 will receive pressure flow from the pump 54, when the valve 62 is shifted to the right, whereby conduit 60 is connected with conduit 86. Simultaneously, conduit 94 will be connected with reservoir 56 through conduits 88, 66 and 68. The rams 38 and 40 will receive equal volumes of hydraulic fluid at their head ends causing the rods 46 and 52 to be extended and the blade 10 to be pitched forward. Shifting of the valve 62 to the left will reverse the connections to the pump 54 and the reservoir 56. Fluid pressure will be directed through conduits 60, 88 and 94 to valve 102 where it will split to conduits 116 and 118 and the rod ends of rams 38 and 40. The pistons 42 and 48 will be forced to the left retracting the rods 46 and 52 and thereby pitching the blade 10 rearward.

Figure 3:
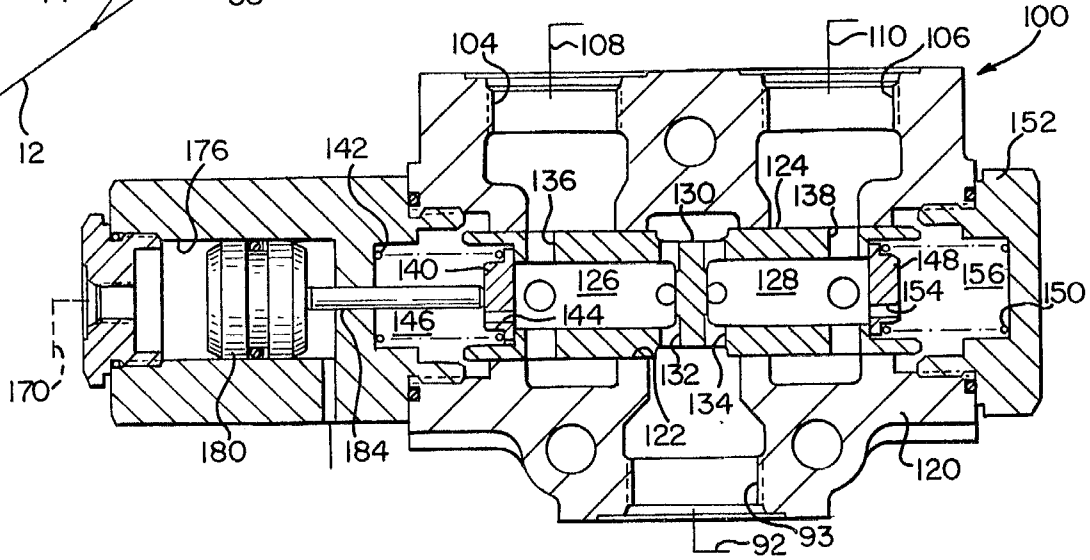
FIG. 3 is a cross-sectional view of a valve used in the circuit of FIG. 2.

Since the valves 100 and 102 are identical, an explanation of valve 100 in FIG. 3 will be sufficient for an understanding of the both valves. The body 120 of valve 100 has a central bore 122 which is intersected by the ports 93, 104 and 106; the port 93 being positioned intermediate the other two ports. A spool 124 is slideably retained in the bore 122 and has a pair of separate and independent central cavities 126 and 128. A circumferential groove 130 is provided on the spool 124 and cross drilled passages 132 and 134 through the groove 130 intersect the cavities 126 and 128 respectively. Another set of cross drilled passages 136 and 138 also respectively intersect cavities 126 and 128. Passages 136 and 138 are positioned longitudinally on the spool 124 so that, with the spool centered, they are immediately adjacent the intersections of the ports 104 and 106 with the bore 122. A spring guide 140 closes cavity 126 and engages a compression spring 142. An orifice 144 in the spring guide 140 provides communication between the cavity 126 and the chamber 146 behind the spring guide 140. A similar spring guide 148 closes cavity 128 and engages a compression spring 150 trapped between the guide 148 and a cap 152 which seals central bore 122. An orifice 154 in the guide 148 provides fluid communication between the cavity 128 and the chamber 156 formed between the guide 148 and the cap 152.

Hydraulic fluid under pressure is provided at the port 93 by conduit 92, the directional control valve having been moved to the right to pitch the blade forward. That flow will pass through the passages 132 and 134 and into cavities 126 and 128, through the passages 136 and 138, through parts 104 and 106 into conduits 108 and 110. As long as the resistances, as evidenced by the pressures in the conduits 108 and 110 are the same, the spool 124 will remain centered, as shown in FIG. 3, under the influence of the springs 142 and 150 and the equalized pressures in chambers 146 and 156. However, when a greater resistance to movement is encountered by one of the rams 38 and 40, the pressure in one conduit will increase. Since hydraulic fluid inherently will follow the pattern of least resistance, more fluid would normally flow to the ram which was encountering the lesser resistance. Assuming for illustration that ram 38 is encountering a greater resistance to its movement, the pressure in conduit 108 would immediately increase relative to the pressure in conduit 110. The port 104 will also be subjected to this higher pressure which will be communicated through the passage 136 and into the chamber 146, by way of the cavity 126 and the orifice 144. The pressure in chamber 146 would then be higher than the pressure in chamber 156. The resulting imbalance of forces on spool 124 will shift the spool to the right as viewed in FIG. 3. As the spool 124 moves to the right, the passage 138 is partially covered, restricting the flow into the conduit 110. This creates an increase in pressure within the cavity 128 which is then communicated to chamber 156 through orifice 154. When the pressure in chamber 156 equals that pressure in chamber 146, the spool 124 is again balanced and the flow to conduits 108 and 110 are equalized. A similar action occurs when the higher pressure occurs in conduit 110. The orifices 144 and 154 restrict the rate of fluid flow into and out of their associated chambers 146 and 156 and thereby dampen the tendancy of the spool 124 to "hunt".

To effect tilting of the blade 10 only one of the rams 38 and 40 is extended or retracted while the other ram is prevented from movement. A mode valve, which may be a two-position pneumatic valve 160 is connected with a source of air pressure 162 through supply conduit 164. Shifting the valve 160 to the left; as viewed in FIG. 2, will connect the supply conduit 164 with air line 166 which communicates with an actuator 168 on the selector valve 84. Air pressure in the actuator 168 will shift the valve 84 to the left against the bias of spring 90. The conduits 92 and 94 will thereby be blocked and conduits 96 and 98 will be placed in communication with the conduits 86 and 88; conduit 96 being connected with conduit 110 and conduit 98 being connected with conduit 118. The ram 40 may then be extended or retracted by manipulation of the directional control valve 62.

To insure that the ram 38 is hydraulically locked, an air line 170 connects between air line 166 and a cylinder 172 formed on the valve 102. A branch line 174 connects between line 170 and a similar cylinder 176. Pistons 178 and 180 are reciprocable in cylinders 174 and 176 respectively, and pins 182 and 184 respectively engage the piston 178 and 180 and the associated spring guides. When air pressure is directed to the actuator 168, it is also directed to act against the pistons 178 and 180 which forces them to the right, moving the pins 182 and 184 to thereby shift the spools of valves 100 and 102 to an extreme right position in which passage 138, and corresponding passages in valve 102, are totally blocked. The conduits 110 and 118 are therefore sealed off and there can be no communication with ram 38 of that pressure directed toward ram 40. The ram 38 will remain hydraulically locked, while the operator is free to tilt the blade 10 either to the right or left as desired by manipulation of valve 62. It is to be noted that the tilting is achieved while maintaining the originally set pitch for the blade 10.

When it is desired to return to a pitch mode, the valve 160 is returned to the position shown in FIG. 2, wherein the conduits 166, 170 and 174 are exhausted to atmosphere through exhaust line 190 and supply line 164 is blocked. The spring 90 will shift the valve 84 to the right as illustrated, conditioning the valve 84 for pitch operation as determined by the valve 62. Simultaneously, the loss of air pressure in the cylinder 172 and 176 will permit the springs, such as spring 150, to center the spools in valves 100 and 102. Subsequent manipulation of the valve 62 will permit pitching of the blade 10. It is to be noted that the tilt angle previously set on the blade 10 will be maintained through the subsequent pitch alteration since rate of flows both to and from the rams 38 and 40 are equalized regardless of pump output or pressures encountered. There is a limit, however, to the independent pitch operations. Should one of the cylinders reach the limit of its stroke during a pitch change operation, as may occur because of a previously set tilt angle, the pressure in the ram at its limit will increase. This increase in pressure will cause the spool, 124 for example, to shift in the same manner as previously described, restricting flow to the still moveable ram. The flow will be at a low rate, but, the still moveable ram will be permitted to complete its stroke also, if the operator desires by maintaining the position of the valve 62. Under such conditions the desired pitch would be achieved, although the previously set tilt angle would be altered or completely eliminated.

While the preferred form of the invention has been shown in concise and detailed manner to clearly and concisely illustrate the principles of the invention, it is to be understood there is no intention to limit or narrow the invention beyond the broad concept set forth in the appended claims.

What is claimed is:

1. In a tractor having a hydraulic circuit including a pump and a reservoir, and a dozer blade mounted on push arms with a pair of hydraulic rams having head and rod ends extending between the blade and each of said push arms, an improved control for pitching said blade comprising:

a directional control valve selectively connecting selected ends of said rams of said pump and reservoir for simultaneous extension or simultaneous retraction of the rams;

a first diverter-combiner spool valve interposed between said pump and reservoir and the head ends of said rams and operative to provide equal flow to said rams during extension thereof while combining the flow therefrom during retraction of the rams;

a second diverter-combiner spool valve interposed between said pump and said revervoir and the rod ends of said rams and operative to combine the flow from said rams during extension thereof and to provide equal flow thereto during retraction of the rams; and a selector valve positioned downstream of said control valve, said selector valve having two positions, one in which communication of said pump and reservoir is achieved with both rams through said diverter-combiner valves and the other in which communication of said pump and reservoir is achieved with only one ram independently of said diverter-combiner valves.

2. The invention according to claim 1, wherein:

said selector valve is spring biased to said one position and an air actuator shifts said selector valve to said other position.

3. The invention according to claim 2, wherein:

said first and second valves include disabling means for preventing communication between said rams.

4. The invention according to claim 3, and further comprising:

a pneumatic valve capable of directing air pressure simultaneously to said actuator and to said disabling means.

* * * * *